US009781535B2

(12) United States Patent
Brockmole et al.

(10) Patent No.: US 9,781,535 B2
(45) Date of Patent: Oct. 3, 2017

(54) MULTI-CHANNEL AUDIO UPMIXER

(71) Applicant: Harman International Industries, Inc., Stamford, CT (US)

(72) Inventors: Jeffrey Michael Brockmole, Brighton, MI (US); Kevin Eric Heber, Carmel, IN (US)

(73) Assignee: Harman International Industries, Incorporated, Stamford, CT (US)

( * ) Notice: Subject to any disclaimer, the term of this patent is extended or adjusted under 35 U.S.C. 154(b) by 83 days.

(21) Appl. No.: 14/713,231

(22) Filed: May 15, 2015

(65) Prior Publication Data

US 2016/0336014 A1 Nov. 17, 2016

(51) Int. Cl.

| | |
|---|---|
| ***H04R 5/00*** | (2006.01) |
| ***H04S 3/00*** | (2006.01) |
| *H04S 5/00* | (2006.01) |
| *H04S 5/02* | (2006.01) |

(52) U.S. Cl.

CPC ..... *H04S 3/008* (2013.01); *H04S 5/005* (2013.01); *H04S 5/02* (2013.01); *H04S 2400/01* (2013.01); *H04S 2400/03* (2013.01)

(58) Field of Classification Search

CPC .... H04N 5/60; H04S 1/00; H04S 5/00; H04S 5/02; H04S 3/00; H04S 7/00; H04S 3/02; H04S 1/002; H04S 1/005; H04S 7/30; H04S 7/301; H04S 5/005; H04R 3/12; H04R 5/02; H04R 5/00; H04R 5/005; H04R 5/033; H04R 2203/00; H04R 3/00; H04R 3/002; H04R 3/005; H04R 3/007; H04R 3/02; H04R 3/04; H04R 3/06; H04R 3/08; H04R 3/10; H04R 3/14; H04R 19/013; H04R 19/02; H04R 11/00; H04R 11/02; H04R 9/00; H04R 2420/01; H04R 25/43; G10K 15/00; H04B 1/16; H04B 14/04; H04B 1/00; H04H 5/00; G10L 19/008; G10L 19/00; G10L 19/167; G10L 19/24; G10L 21/038; G10H 1/16; H03G 3/00; G11B 20/10527

USPC ..... 381/1, 17, 18, 19, 302, 303, 306, 307, 381/310, 311, 61, 119, 111, 116, 117, (Continued)

(56) References Cited

U.S. PATENT DOCUMENTS 6,236,730 B1 * 5/2001 Cowieson ..... H04S 3/00 381/18
2003/0206639 A1 * 11/2003 Griesinger ..... H04S 7/302 381/20

(Continued)

FOREIGN PATENT DOCUMENTS

CA 2560034 C 9/2014
EP 2653974 A2 10/2013

*Primary Examiner* — Leshui Zhang
(74) *Attorney, Agent, or Firm* — Brooks Kushman P.C.

(57) ABSTRACT

An audio processor may receive audio input channels including stereo channels and one or more surround channels. The audio processor may downmix the audio input channels into stereo output channels; developing the stereo output channels into upmixed audio channels including at least one additional surround channel not present in the audio input channels; delay the audio input channels into delayed audio channels that are time-aligned with the upmixed audio channels; and mix the delayed audio channels and the upmixed audio channels into audio output channels.

20 Claims, 4 Drawing Sheets

(58) Field of Classification Search
USPC ..... 381/118, 27, 20–23; 700/94; 704/500; 386/239
See application file for complete search history.

(56) References Cited

U.S. PATENT DOCUMENTS

2005/0281408 A1* 12/2005 Kim ..... H04S 3/002 381/17
2006/0039573 A1* 2/2006 Vernon ..... H04R 5/02 381/119
2006/0106620 A1* 5/2006 Thompson ..... G10L 19/008 704/500
2011/0026738 A1* 2/2011 Aoki ..... H04H 60/04 381/119

* cited by examiner

MULTI-CHANNEL AUDIO UPMIXER

TECHNICAL FIELD

Aspects disclosed herein generally relate to upmixing multi-channel audio, and in particular to upmixing multi-channel audio using an upmixer having fewer input channels than included in the multi-channel audio.

BACKGROUND

During a recording session, a sound engineer may receive direct feeds from instruments and/or position microphones among members of a band or other sources in order to receive sounds for recording. Using sound mastering equipment, the sound engineer may mix or adjust one or more of these input channels from which audio signals were received. In an example, the sound engineer may adjust individual audio signals to make the position of the singer be perceived by listeners to be in a central location when the recording is played through the loudspeakers of an audio system, a violin be perceived as to the left side of the singer, and a guitar be perceived as to the right side of the singer. These audio signals may be stored to an audio storage format for playback.

Audio systems may receive a stereo audio input signal, and develop more output channels than the received input channels. Such systems may distribute the audio input signal to the output channels based on analysis of aspects of one or more of the phasing, frequency, gain, correlation, harmonic content, harmonic decay, etc. of the audio input signals in the received channels with respect to one another. The process by which additional output channels are developed from the received input channels may be referred to as upmixing.

SUMMARY

In a first illustrative embodiment, an audio processing system includes an audio processor; an input mixer module configured to downmix audio input channels including stereo and one or more surround channels into stereo output channels; a stereo upmixer module executable by the audio processor to develop the stereo output channels into upmixed audio channels including at least one additional surround channel not present in the audio input channels; a delay module executable by the audio processor to delay the audio input channels into delayed audio channels that are time-aligned with the upmixed audio channels generated by the stereo upmixer module; and an output mixer module configured to mix the delayed audio channels and the upmixed audio channels into audio output channels.

In a second illustrative embodiment, a method of processing an audio signal includes receiving audio input channels with an audio processor, the audio input channels including audio in a first format; downmixing at least a subset of the audio input channels into fewer output channels, the fewer output channels corresponding to an input channel format of an audio upmixer; developing the fewer output channels into upmixed audio channels using the audio upmixer; delaying the audio input channels into delayed audio channels that are time-aligned with the upmixed audio channels; and mixing the delayed audio channels and the upmixed audio channels into audio output channels in a second format.

In a third illustrative embodiment, a non-transitory computer-readable medium includes instructions that, when executed by an audio processor, are configured to cause the audio processor to receive audio input channels with the audio processor, the audio input channels including stereo and one or more surround channels; downmix at least a subset of the audio input channels into stereo output channels; develop the stereo output channels into upmixed audio channels including at least one additional surround channel not present in the audio input channels; delay the audio input channels into delayed audio channels that are time-aligned with the upmixed audio channels; and mix the delayed audio channels and the upmixed audio channels into audio output channels.

BRIEF DESCRIPTION OF THE DRAWINGS

The embodiments of the present disclosure are pointed out with particularity in the appended claims. However, other features of the various embodiments will become more apparent and will be best understood by referring to the following detailed description in conjunction with the accompany drawings in which:

DETAILED DESCRIPTION

Figure 1:
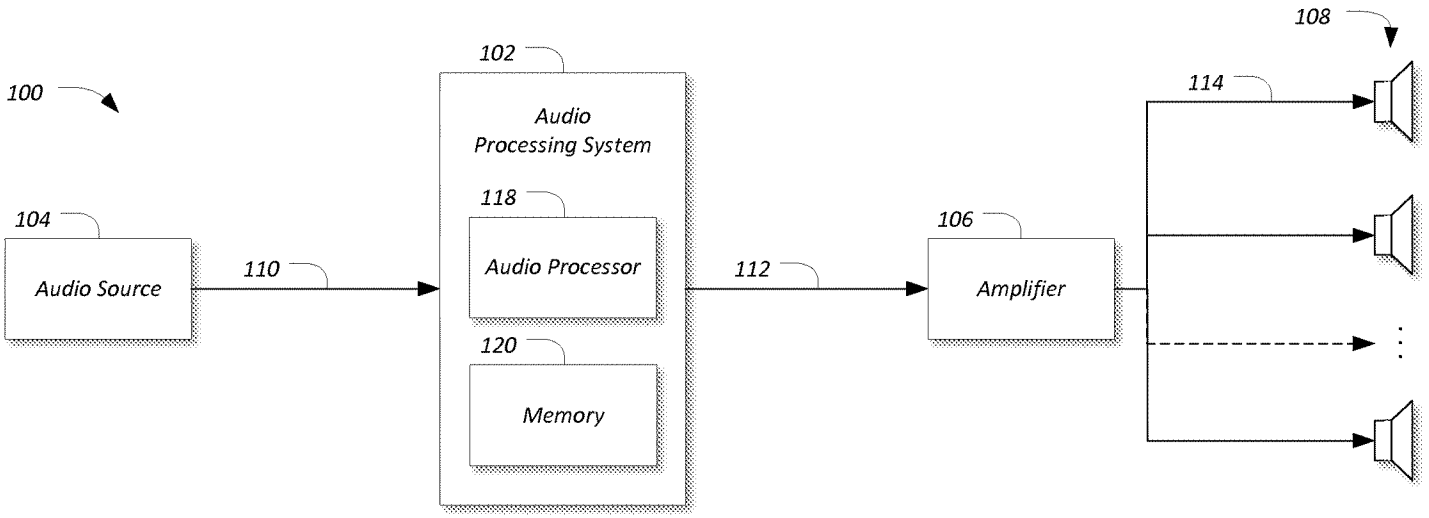
FIG. 1 is a block diagram of an example audio system that includes an audio processing system, in accordance to one embodiment.

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

A stereo upmixer may perform digital signal processing (DSP) to produce multi-channel audio (e.g., 5.1 surround, 7.1 surround, etc.) from a stereo source signal. Upmixers may include intensive algorithms which consume significant processing and memory resources. A multi-channel upmixer may similarly utilize DSP to produce even more channels from a multi-channel source (e.g., converting 5.1 surround into 7.1 surround, in an example). Due to the increased amount of data that multi-channel upmixers receive and process, multi-channel upmixers may include even more intensive algorithms than their stereo upmixer counterparts. For instance, a multi-channel upmixer processing 5.1 surround channel inputs may consume greater resources than a stereo upmixer processing left and right channel inputs.

An improved multi-channel upmixer may utilize an upmixer having fewer input channels than the format of the original multi-channel input, as well as an input mixer and an output mixer. For example, a stereo upmixer may be utilized to perform upmixing of a 5.1 surround multi-channel input into 7.1 surround channels. In such an example, the input upmixer may downmix the original multi-channel input into a stereo source signal, which may be applied to inputs to the stereo upmixer. The output of the stereo upmixer may be applied to inputs of the output mixer, along with a delayed version of the original multi-channel data, allowing the output mixer to intelligently combine the upmixer output and the original multi-channel data to create a final multi-channel output. The final multi-channel output may accordingly approximate the output of a true multi-channel upmixer.

To provide for the downmixing and combination, the system may utilize gains, filters, delays and other processing elements. Moreover, the mixers may operate in the time domain, even if the stereo upmixer performs processing in the frequency domain, and vice-versa.

The improved multi-channel upmixer may accordingly reduce upmixer complexity by moving the source format handlers outside of the upmixer process, as the stereo upmixer may be provided stereo data, independent of the actual input signal format. Moreover, the improved multi-channel upmixer may allow use with a common set of tuning tools as well as verification with less complex test procedures and vectors.

It should be noted that many examples herein utilize a stereo upmixer to implement a multi-channel upmixer. However, the described techniques are applicable to other scenarios having different numbers of channels. As an example, a system may utilize a 7.2 surround upmixer to convert received 12.4 content into Dolby ATMOS® 34 channel content. In such an example, the input mixer may downmix the received 12.4 channels into 7.2 surround, utilize the 7.2 surround upmixer to develop the downmixed channels into ATMOS® 34 channel content, and utilize the output mixer to combine the 7.2 surround upmixer output and the original multi-channel data to create a final multi-channel output. The final multi-channel output may accordingly approximate the output of a true 12.4 channel to ATMOS® upmixer.

FIG. 1 is an example audio system 100 that includes an audio processing system 102. The audio system 100 may also include at least one source of audio content 104, at least one amplifier 106 and a plurality of loudspeakers 108. The audio processing system 102 may receive audio input signals 110 from the audio source 104, utilize an audio processor 118 and memory 120 to process the audio input signals 110 into audio output signals 112, and provide the audio output signals 112 to the amplifier 106 to drive the loudspeakers 108. Example audio systems 100 include a vehicle audio system, a stationary consumer audio system such as a home theater system, an audio system for a multimedia system such as a movie theater or television, a multi-room audio system, a public address system such as in a stadium or convention center, an outdoor audio system, or an audio system in any other venue in which it is desired to reproduce audible audio sound.

The source of audio content 104 may be any form of one or more devices capable of generating and outputting different audio signals on at least two channels. Examples of the audio source 104 may include a media player, such as a compact disc, video disc, digital versatile disk (DVD), or BLU-RAY disc player, a video system, a radio, a cassette tape player, a wireless or wireline communication device, a navigation system, a personal computer, a codec such as an MP3 player or an IPOD™ or any other form of audio related device capable of outputting different audio signals on at least two channels.

In FIG. 1, the source of audio content 104 produces two or more audio signals on respective audio input channels 110 from source material such as pre-recorded audible sound. The audio signals may be audio input signals produced by the source of audio content 104, and may be analog signals based on analog source material, or may be digital signals based on digital source material. Accordingly, the source of audio content 104 may include signal conversion capability such as analog-to-digital or digital-to-analog converters. In one example, the source of audio content 104 may produce stereo audio signals consisting of two substantially different audio signals representative of a right and a left channel provided on two audio input channels 110. In another example, the source of audio content 104 may produce greater than two audio signals on greater than two audio input channels 110, such as 5.1 surround, 6.1 surround, 7.1 surround, 12.4 surround, ATMOS® audio including up to 34 audio channels, or any other number of different audio signals produced on a respective same number of audio input channels 110.

The amplifier 106 may be any circuit or standalone device that receives audio input signals of relatively small magnitude, and outputs similar audio signals of relatively larger magnitude. Two or more audio input signals may be received by the amplifier 106 on two or more audio output channels 112 and output on two or more loudspeaker connections 114. In addition to amplification of the amplitude of the audio signals, the amplifier 106 may also include signal processing capability to shift phase, adjust frequency equalization, adjust delay or perform any other form of manipulation or adjustment of the audio signals in preparation for being provided to the loudspeakers 108. The signal processing functionality may additionally or alternately occur within the audio processing system 102. Also, the amplifier 106 may include capability to adjust volume, balance and/or fade of the audio signals provided on the loudspeaker connections 114. In an alternative example, the amplifier 106 may be omitted, such as when the loudspeakers 108 are in the form of a set of headphones, or when the audio output channels serve as the inputs to another audio device, such as an audio storage device or audio processor device. In still other examples, the loudspeakers 108 may include the amplifier, such as when the loudspeakers 108 are self-powered.

The loudspeakers 108 may be positioned in a listening space such as a room, a vehicle, or in any other space where the loudspeakers 108 can be operated. The loudspeakers 108 may be any size and may operate over any range of frequency. Each loudspeaker connection 114 may supply a signal to drive one or more loudspeakers 108. Each of the loudspeakers 108 may include a single transducer, or in other cases multiple transducers. The loudspeakers 108 may also be operated in different frequency ranges such as a subwoofer, a woofer, a midrange and a tweeter. Multiple loudspeakers 108 may be included in the audio system 100.

The audio processing system 102 may receive the audio input signals from the source of audio content 104 on the audio input channels 110. Following processing, the audio processing system 102 provides processed audio signals on the audio output channels 112 to the amplifier 106. The audio processing system 102 may be a separate unit or may be combined with the source of audio content 104, the amplifier 106 and/or the loudspeakers 108. Also, in other examples, the audio processing system 102 may communicate over a network or communication bus to interface with the source of audio content 104, the audio amplifier 106, the loudspeakers 108 and/or any other device or mechanism (including other audio processing systems 102).

One or more audio processors 118 may be included in the audio processing system 102. The audio processors 118 may be one or more computing devices capable of processing audio and/or video signals, such as a computer processor, microprocessor, a digital signal processor, or any other device, series of devices or other mechanisms capable of performing logical operations. The audio processors 118 may operate in association with a memory 120 to execute instructions stored in the memory. The instructions may be in the form of software, firmware, computer code, or some combination thereof, and when executed by the audio processors 118 may provide the functionality of the audio processing system 102. The memory 120 may be any form of one or more data storage devices, such as volatile memory, non-volatile memory, electronic memory, magnetic memory, optical memory, or any other form of data storage device. In addition to instructions, operational parameters and data may also be stored in the memory 120. The audio processing system 102 may also include electronic devices, electro-mechanical devices, or mechanical devices such as devices for conversion between analog and digital signals, filters, a user interface, a communications port, and/or any other functionality to operate and be accessible to a user and/or programmer within the audio system 100.

During operation, the audio processing system 102 receives and processes the audio input signals. In an example, during processing of the audio input signals, the audio processor 118 receive audio input channels 110, downmixes the audio input channels 110 into fewer channels, develops the downmixed channels into upmixed audio channels, delays the audio input channels 110 to preserve time-alignment with the upmixed audio channels, and mixes the delayed audio channels and the upmixed audio channels into audio output channels 112. The audio output channels 112 may be provided, in an example, to the amplifier 106 to drive the loudspeakers 108. Further aspects of the processing of the audio processing system 102 are described in detail below with respect to FIGS. 2-4 below.

Figure 2:
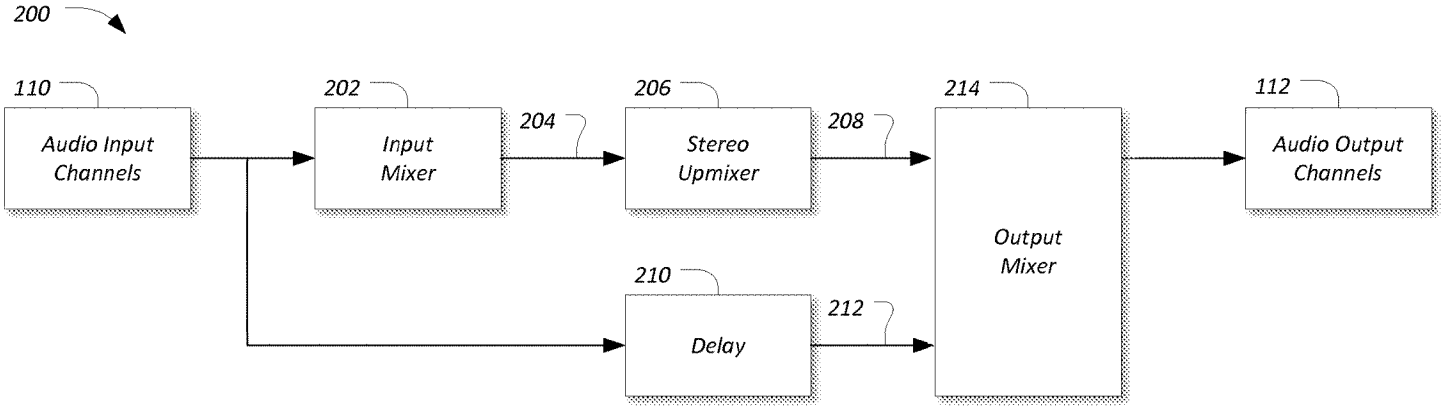
FIG. 2 is a block diagram of an example audio processing system that includes a stereo upmixer operating to perform multi-channel upmixing, in accordance to one embodiment.

FIG. 2 is a block diagram 200 example of functional processing blocks of the audio processing system 102 that includes a stereo upmixer 206 operating to perform multichannel upmixing. As illustrated, the audio processing system 102 includes an input mixer 202, a delay 210, and an output mixer 214 in addition to the stereo upmixer 206. The input mixer 202 receives the audio input channels 110 and mixes them down to a stereo output 204 to provide to the stereo upmixer 206. The stereo upmixer 206 provides the upmixed channel output 208 to the output mixer 214. The delay 210 also receives the original audio input channels 110, and provides delayed audio channels 212 to the output mixer 214 to remain time aligned with the upmixed channel output 208 of the stereo upmixer 206. The output mixer 214 processes the upmixed channel output 208 from the stereo upmixer 206 and the delayed audio channels 212 from the delay 210 to produce the audio output channel 112.

The input mixer 202 may receive some or all of the audio input channels 110 to be summed into stereo output signals 204. In an example, the input mixer 202 may receive all channels from the audio input channels 110. In another example, the input mixer 202 may receive a subset of the channels from the audio input channels 110, such all channels except for those dedicated to low frequency energy (LFE) information (e.g., frequencies below 80 Hz in an example), or another subset of the left (L), right (R), center (C) and surround (Surr) channels, as some other possibilities.

The input mixer 202 may include individual channel inputs and may perform channel processing to the inputs in addition to the summation. In an example, the input mixer 202 may perform channel processing on the C audio input channel 110 to de-emphasize frequencies (e.g., 4-10 kHz in an example) that may be boosted in the center channel to aid in clarity of dominant sounds in a surround mix. In another example, the input mixer 202 may de-emphasize far-left and far-right channel information, which may have been over-emphasized in Surr channels in an attempt to widen a soundstage away from the center. In yet another example, the input mixer 202 may perform high-pass filtering or de-emphasis of L and R (or all) channels to remove LFE information that may be present, in order to avoid undesirable bass emphasis from mixing together multiple channels that each include low frequency information.

The stereo upmixer 206 may receive the stereo output signals 204 from the input mixer 202 to be developed into additional channels. The stereo upmixer 206 may dissect the stereo output signals 204 to separate sources of audible sound included in the stereo output signals 204 into multiple output channels 208 mapped to loudspeakers 108 enveloping the listeners. Separation of the sources of audible sound into channels may be based on processing performed to identify perceived locations of each of the sources of audible sound within a listener-perceived soundstage. Following the processing, the portions of the listener-perceived soundstage may be selectively assembled to form upmixed output channels 208. Since the sources of audible sound are separated and independent, the audible sound sources may be included on any one or more of the upmixed output channels 208. An example stereo upmixer 206 is described in detail in U.S. Patent Application Publication No. 2011/0081024 A1, titled "SYSTEM FOR SPATIAL EXTRACTION OF AUDIO SIGNALS," which is incorporated in its entirety herein by reference. As one possibility, the stereo upmixer 206 may utilize QuantumLogic Surround (QLS) digital signal processing technology implemented by Harman International Industries, Incorporated of Northridge, Calif. In an example, the stereo upmixer 206 may output one or more front channels, back channels, center channels and surround channels, such as 5.1 surround, 6.1 surround, 7.1 surround, 14.2 surround, or any other number of different audio signals on a respective same number of upmixed output channels 208. The upmixed output channels 208 may accordingly be provided to the output mixer 214.

The delay 210 may also receive some or all of the audio input channels 110 to be delayed and provided to the output mixer 214 as delayed audio channels 212. Accordingly, the delay 210 may serve to allow the original audio input channels 110 to be time-aligned with the output of the stereo upmixer 206, as the upmixed output channels 208 may incur a time delay due to the processing time involved in the signal processing performed to the audio input channels 110 by the stereo upmixer 206. It should be noted that in many examples, the delays 210 are depicted as functional elements separate from the input mixer 202, but it should be noted that in some implementations the input mixer 202 and delays 210 may be combined as a single unit.

The output mixer 214 may receive both the upmixed output channels 208 from the stereo upmixer 206 and the delayed audio channels 212 from the delay 210 to be summed into upmixed audio output channels 112. The output mixer 214 may include individual channel inputs for each of the upmixed output channels 208 and delayed audio channels 212, and may sum the upmixed output channels 208 and delayed audio channels 212 to generate the resultant upmixed audio output channels 112. Accordingly, by summing in the delayed audio channels 212 with the upmixed output channels 208, the audio processing system 102 may maintain at least a portion of the original artistic intent as provided in the input format mix. In an example, the output mixer 214 may mix each of the channels in accordance with its type (e.g., mix C upmixed output channel 208 with C delayed audio channel 212). In another example, the output mixer 214 may additionally sum across types (e.g., sum side channels into rear audio output channels 112, sub center channels into front audio output channels 112, etc.)

As a more specific example, the output mixer 214 may sum a left front (LF) upmixed output channel 208 with a LF delayed audio channel 212, a right front (RF) upmixed output channel 208 with a RF delayed audio channel 212, a C upmixed output channel 208 with a C delayed audio channel 212, a left side (LS) upmixed output channel 208 with a left surround (LSurr) delayed audio channel 212, and a right side (RS) upmixed output channel 208 with a right surround (RSurr) delayed audio channel 212. In some examples, the upmixed output channel 208 and the delayed audio channel 212 may be summed in equal proportions, while in other examples, one of the upmixed output channel 208 and the delayed audio channel 212 may be boosted, de-emphasized or otherwise given a higher or lower priority in a mix. In still other examples, one or more of the upmixed output channel 208 and the delayed audio channel 212 may be omitted in the mix. For instance, the original LF and RF may be utilized as the upmixed LF and RF (e.g., in the form of the L and R delayed audio channels 212), without contribution made by the LF upmixed output channel 208 or the RF upmixed output channel 208. Regardless of specific mix, the upmixed audio output channels 112 may be stored to an audio storage format and/or provided to one or more loudspeakers 108 for playback.

Figure 3A:
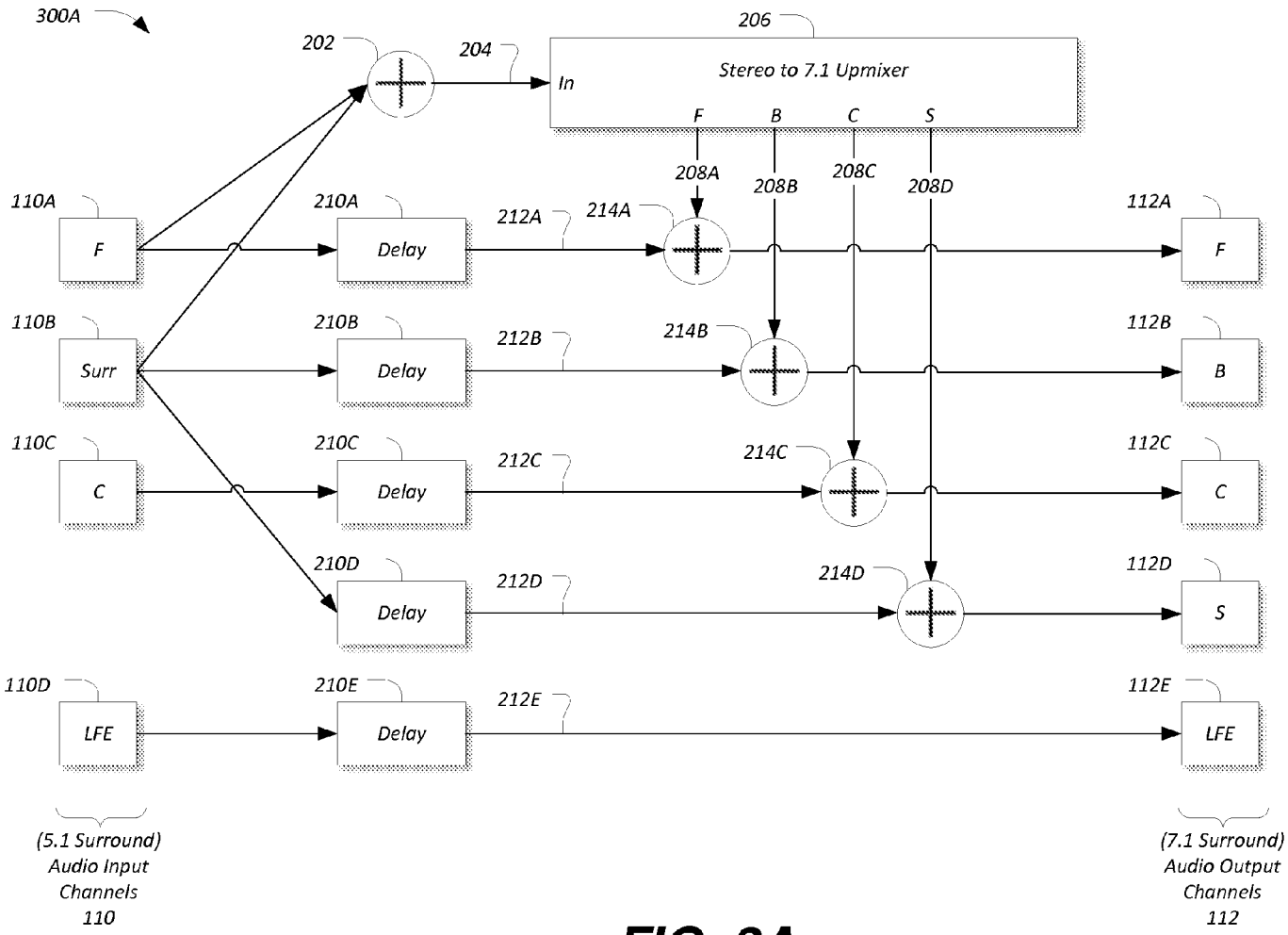
FIG. 3A is a block diagram of an example of functional processing blocks of the audio processing system operating to process 5.1 surround audio input channels into 7.1 surround audio output channels, in accordance to one embodiment.

FIG. 3A is a block diagram 300A of an example of functional processing blocks of the audio processing system 102, operating to process 5.1 surround audio input channels 110 into 7.1 surround audio output channels 112 using a stereo to 7.1 upmixer 206.

As shown, the 5.1 surround front audio channels 110A (i.e., a LF channel and a RF channel) are provided to the input mixer 202. Additionally, the 5.1 surround channels 110B (i.e., a LS channel and a RS channel) are provided to the input mixer 202. The input mixer 202 sums the LF audio input channel 110A and the LSurr audio input channel 110B to generate the L stereo output 204, and sums the RF audio input channel 110A and the RSurr audio input channel 110B to generate the R stereo output 204. The stereo output 204 is provided to the stereo to 7.1 upmixer 206, which generates a set of 7.1 surround signals that are provided to the output mixer 214. These 7.1 surround signals include, in an example, LF and RF upmixed output channels 208A provided to output mixer 214A, left back (LB) and right back (RB) upmixed output channels 208B provided to output mixer 214B, a C upmixed output channel 208C provided to output mixer 214C, and LS and RS upmixed output channels 208D provided to output mixer 214D.

The delays 210A through 210E also receives the 5.1 surround audio input channels 110, which are delayed into delayed audio channels 212 and provided to the output mixers 214A through 214E. For instance, the delay 210A delays the LF and RF audio input channel 110A to generate the LF and RF delayed audio channel 212A, respectively, which are provided to the output mixer 214A. The delay 210B delays the LSurr and RSurr audio input channels 110B to generate the LB and RB delayed audio channel 212B, respectively, which are provided to the output mixer 214B. The delay 210C delays the C audio input channel 110C to generate the C delayed audio channel 212C, which is provided to the output mixer 214C. The delay 210D delays the LSurr and RSurr audio input channels 110B, but to generate the LS and RS delayed audio channel 212D, which is provided to the output mixer 214D. The delay 210E delays the LFE channel 110D to generate the LFE delayed audio channel 212E, which is provided through as the LFE audio output channel 112E of the 7.1 surround audio output channels 112.

The output mixer 214A sums the FL and FR delayed audio channels 212A with the FL and FR upmixed output channels 208A, respectively, to generate the FL and FR audio output channels 112A. The output mixer 214B sums the LB and RB delayed audio channels 212B with the LB and RB upmixed output channels 208B, respectively, to generate the LB and RB audio output channels 112B. The output mixer 214C sums the C delayed audio channel 212C with the C upmixed output channels 208C to generate the C audio output channels 112C. The output mixer 214D sums the LS and RS delayed audio channels 212D with the LS and RS upmixed output channels 208D, respectively, to generate the LS and RS audio output channels 112D. Thus, the stereo to 7.1 upmixer 206 may be utilized to generate 7.1 surround audio output channels 112 from 5.1 surround audio input channel 110.

Variations on the block diagram 300A are possible. In an alternate example, a single delay 210 may be utilized generate both the LB and RB delayed audio channels 212B and also the LS and RS delayed audio channels 212D. However, as it may be desirable to perform different delay or other processing to generate the LB and RB delayed audio channels 212B as compared to the LS and RS delayed audio channels 212D, the signal flow may include different delays 210 and/or different processing before or after a common delay 210 to generate the LB and RB delayed audio channels 212B and the LS and RS delayed audio channels 212D. For instance, the LB and RB delayed audio channels 212B may be delayed an additional amount beyond the delay time applied to the LS and RS delayed audio channels 212D. As another possibility, different phase shifting, equalization, and/or amounts of gain may be applied to generate the LB and RB delayed audio channels 212B as compared to generation of the LS and RS delayed audio channels 212D.

Figure 3B:
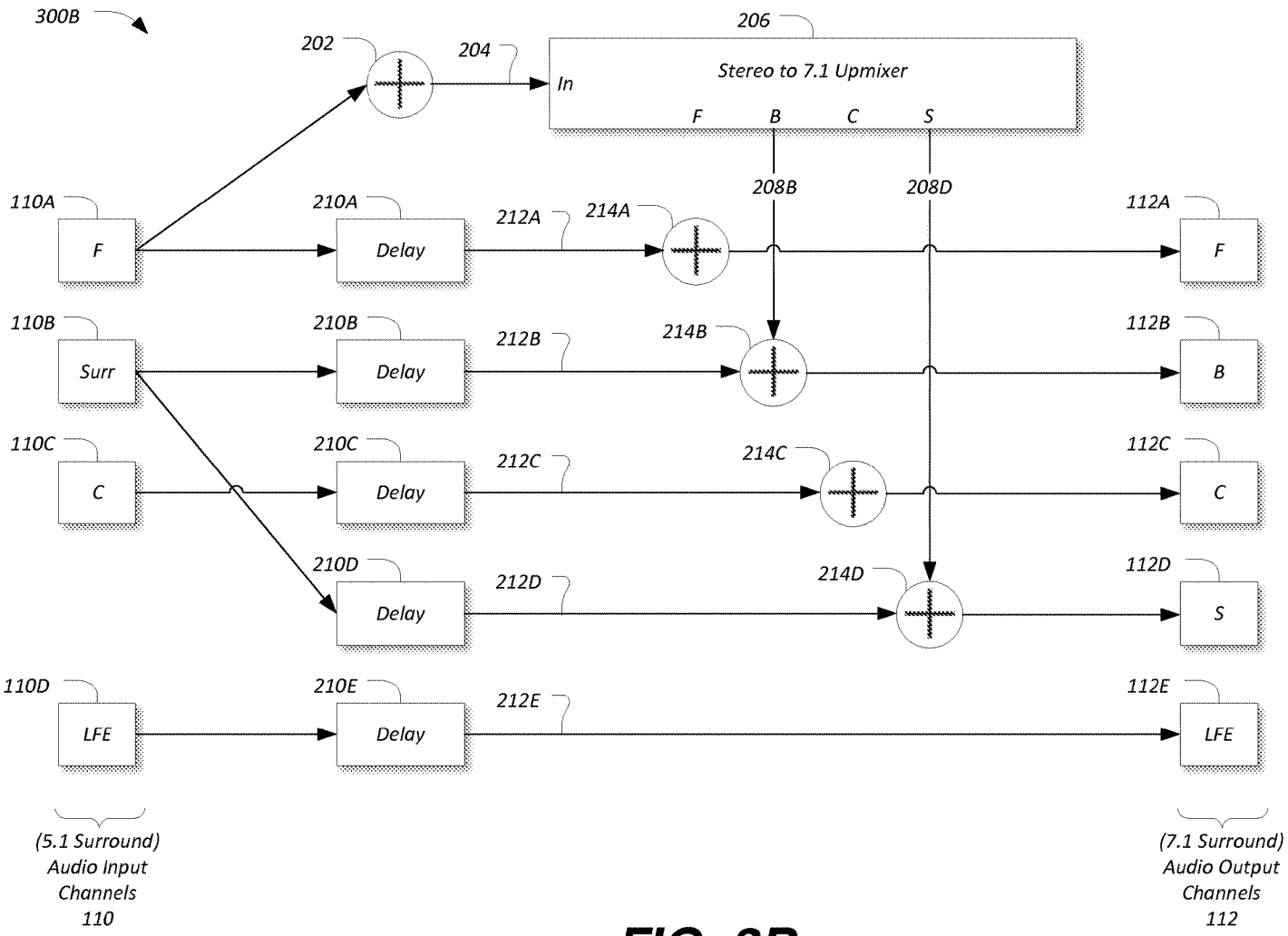
FIG. 3B is a block diagram of an alternate example of functional processing blocks of the audio processing system operating to process 5.1 surround audio input channels into 7.1 surround audio output channels, in accordance to one embodiment.

FIG. 3B is a block diagram 300B of an alternate example of functional processing blocks of the audio processing system 102 operating to process 5.1 surround audio input channels 110 into 7.1 surround audio output channels 112, using a stereo to 7.1 upmixer 206. As compared to the diagram 300A, in which the 5.1 surround channels 110B are provided to the stereo upmixer 206 and the upmixed output channels 208A and 208C are utilized to provide contributions to the 7.1 surround audio output channels 112, in the diagram 300B the stereo upmixer 206 receivers contribution only from the LF and RF audio channels 110A, and provides contribution only to the LB and RB audio output channels 112B and LS and RS audio output channels 112D.

Table 1 illustrates example mixer settings of the audio processing system 102 in accordance with the block diagram 300B. The mixer settings may be stored to the memory 120 of the audio processing system 102, and may be used by the audio processing system 102 to set amounts of gain to be applied to audio signals during the audio processing performed by the audio processor 118 as described in detail above. As illustrated in the Table 1, the amounts of gain are specified in terms of voltage ratio (e.g., $V_{out}/V_{in}$), but in other examples the amounts of gain may be specified as decibels (dB), a power ratio, or another suitable format.

TABLE 1

Example Mixer settings

| 5.1 Audio Input Channels | Downmixed Stereo Output | Upmixed Output Channels | 7.1 Audio Output Channels |
|---|---|---|---|
| LF_in | LF_in * 1.0 | LF_upmix | LF_in * 1.0 |
| RF_in | RF_in * 1.0 | RF_upmix | RF_in * 1.0 |
| C_in | n/a | C_upmix | C_in * 1.0 |
| LSurr_in | n/a | LS_upmix | LS_upmix * 0.5 + LSur_in * 0.5 |
| RSurr_in | n/a | RS_upmix | RS_upmix * 0.5 + RSur_in * 0.5 |
| LFE_in | n/a | LB_upmix | LB_upmix * 0.5 + LSur_in * 0.5 |
| n/a | n/a | RB_upmix | RB_upmix * 0.5 + RSur_in * 0.5 |
| n/a | n/a | n/a | LFE_in * 1.0 |

As shown in the Table 1, the input mixer 202 may apply gain of 1.0 to each of the LF and RF audio channels 110A to generate the L and R stereo output 204 provided to the stereo upmixer 206. Also as shown in the Table 1, the output mixer 214 may apply a gain of 1.0 to the LF and RF delayed audio channels 212A, to the C delayed audio channels 212C, and to the LFE_in audio input channel 110D to generate the LF and RF audio output channels 112A, the C output channel 112B, and the LFE audio output channel 112E, respectively. (In some cases, gain specified for the LFE delayed audio channels 212E may be performed by the delay 210E or by the input mixer 202, as some other possibilities.) Also as shown in the Table 1, the output mixer 214 may apply a gain of 0.5 to each of the LB and RB delayed audio channels 212B generated from the Surr audio input channels 110B and to each of the LB and RB upmixed output channels 208B to generate the LB and RB audio output channels 112B, respectively. Also, the output mixer 214 may apply a gain of 0.5 to each of the LS and RS delayed audio channels 212D generated from the Surr audio input channels 110B and to each of the LS and RS upmixed output channels 208D to generate the LS and RS audio output channels 112D, respectively.

It should be noted that the illustrated mixer settings of Table 1 are but one example, and different mixer settings may be used. Moreover, it should further be noted that the mixer settings of the audio processing system 102 may be user configurable, and may be adjustable during the processing of audio input channels 110 into audio output channels 112. As one possibility, the mixer settings may be driven dynamically by the audio processor 118 based on signal analysis of the content of the audio input channels 110 (e.g., a first set of mixer settings may be used for audio input channels 110 encoded at a first bitrate, and a second set of mixer settings may be used for audio input channels 110 encoded at a second bitrate). As another possibility, the mixer settings may be driven dynamically by the audio processor 118 based on a format detection of the audio input channels 110 (e.g., a first set of mixer settings may be used for audio input channels 110 in a 5.1 surround format, and a second set of mixer settings may be used for audio input channels 110 in a 7.1 surround, stereo, or other format). As yet a further example, the mixer settings may be driven dynamically by the audio processor 118 based on retrieved metadata included in the audio input channels 110 specifying the mixer settings to be used (e.g., specifying an identifier of a mixer settings preset of the audio processing system 102, specifying the particular mixer settings to be applied, etc.).

Figure 4:
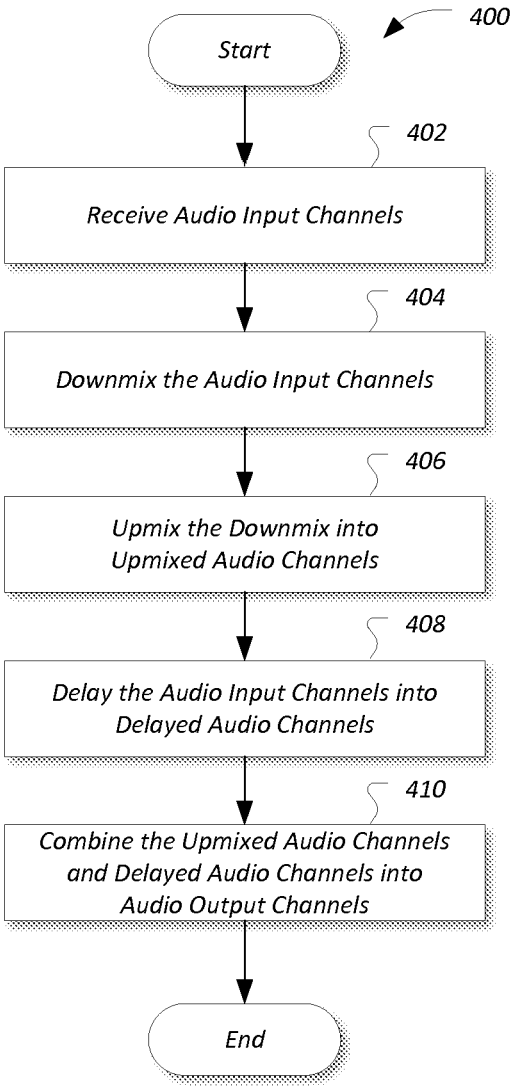
FIG. 4 is an example operational flow diagram of the audio processing system of FIG. 1, in accordance to one embodiment.

FIG. 4 illustrates an example operational flow diagram 400 of the audio processing system 102, described with reference to the FIGS. 1-3. In the example, the audio processing system 102 receives the audio input channels 110 including stereo and surround audio signals, and processes the audio input channels 110 into audio output channels 112 including a greater number of channels than included in the audio input channels 110 using the stereo upmixer 206. In another example, the audio processing system 102 may process the audio input channels 110 into audio output channels 112 including a different presentation of the same set of channels included in the audio input channels 110.

At operation 402, the audio processing system 102 receives audio input channels 110. In an example, the audio input channels 110 are received from the source of audio content 104. The source of audio content 104 may be a media player, a live performance, an audio/video feed, or some other source of audio content 104 including audio input channels 110 for processing. In an example, the format of the audio input channels 110 may be a surround format, such as 5.1 surround, 7.1 surround, or 14.2 surround, as some possibilities.

At operation 404, the audio processing system 102 downmixes the audio input channels 110. The downmixing may be performed, for example, to adjust the format of the audio input channels 110 to match the inputs to the upmixer. In an example, the input mixer 202 receives some or all of the audio input channels 110, and sums the received audio input channels 110 into the stereo output signals 204 to be applied to stereo inputs to the stereo upmixer 206. The input mixer 202 may further apply amounts of gain or other audio processing to the audio input channels 110 in accordance with the mixer settings of the audio processing system 102.

At operation 406, the audio processing system 102 upmixes the downmixed channels into the upmixed channel output 208. Thus, by performing the downmixing of the audio input channels 110, upmixing may be performed utilizing an upmixer having fewer input channels than the audio input channels 110. In an example, the stereo upmixer 206 receives the stereo output signals 204 downmixed from the audio input channels 110, and develops the stereo output signals 204 into upmixed channel outputs 208 including additional channels. For instance, the stereo upmixer 206 may generate 7.1 surround upmixed channel outputs 208

(e.g., LF_upmix, RF_upmix, C_upmix, LS_upmix, RS_upmix, LB_upmix, RB_upmix) from the received stereo output signals 204.

At operation 408, the audio processing system 102 delays the audio input channels 110 into delayed audio channels 212. In an example, the delay 210 also receives the original audio input channels 110, and generates delayed audio channels 212 to remain time aligned with the upmixed channel output 208 of the stereo upmixer 206. The delay 210 functionality may be included in the input mixer 202, while in other examples the delay 210 functionality may be implemented separate from the input mixer 202.

At operation 410, the audio processing system 102 combines the upmixed channel output 208 and the delayed audio channels 212 into the audio output channels 112. In an example, the output mixer 214 receives the upmixed channel outputs 208 and the delayed audio channels 212, and combines them to form the audio output channels 112. The output mixer 214 may further apply amounts of gain to the upmixed channel outputs 208 and the delayed audio channels 212 being summed in accordance with the mixer settings of the audio processing system 102. After operation 410, the process 400 ends.

Thus, the audio processing system 102 may be able to utilize a stereo upmixer 206 to convert both stereo input formats and also surround input formats into a surround format having a greater number or specific set of channels (e.g., convert a stereo input format into a 5.1 surround input format; convert a 5.1 surround input format into a 7.1 surround format; convert a 5.1 surround input format into a different presentation of 5.1 surround, etc.). As the same stereo upmixer 206 may be utilized for different input formats, the audio processing system 102 may be simplified as compared to audio processing systems 102 having different upmixers for use in converting stereo audio formats as compared to surround audio formats. Moreover, as the resultant surround channels provided by the audio processing system 102 account for audio information included in received surround channels, the audio processing system 102 may be able to upmix surround formats to greater channel surround formats, while maintaining original artistic intent as provided in the input format mix.

Variations on the audio processing system 102 are possible. In an example, instead of the stereo upmixer 206, the audio processing system 102 may utilize a multi-channel upmixer having fewer input channels than the audio input channels 110 to convert the audio input channels 110 into audio output channels 112. For instance, the audio processing system 102 may utilize a 7.2 upmixer to convert 12.4 content into Dolby ATMOS® 34 audio channel content. In such an example, the input mixer 202 may downmix the 12.4 audio input channels 110 into 7.2 surround channels, the 7.2 upmixer may upconvert the 7.2 surround channels into ATMOS®, the delay 210 may receive the original audio input channels 110 to provide delayed audio channels 212 to the output mixer 214 to remain time aligned with the upmixed channel output 208, and the output mixer 214 may mix delayed audio channels 212 of the 12.4 content with the upmixed channel output 208 of the 7.2 upmixer to produce the desired ATMOS® audio output channels 112. Thus, as another possibility a 7.2 upmixer may be used to upconvert 12.4 content into Dolby ATMOS® 34 audio channel content, without requiring the additional resources and complexity of using a native 12.4 to ATMOS® upmixer.

Computing devices described herein, such as the audio processors 118 of the audio processing system 102, generally include computer-executable instructions, where the instructions may be executable by one or more computing devices such as those listed above. Computer-executable instructions may be compiled or interpreted from computer programs created using a variety of programming languages and/or technologies, including, without limitation, and either alone or in combination, Java™, JavaScript, C, C++, C#, Visual Basic, Java Script, Python, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of computer-readable media.

With regard to the processes, systems, methods, heuristics, etc., described herein, it should be understood that, although the steps of such processes, etc., have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claims.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. An audio processing system comprising:

an input mixer configured to downmix audio input channels including stereo and one or more surround channels into stereo output channels;

a stereo upmixer configured to develop the stereo output channels into upmixed audio channels including at least one additional surround channel not present in the audio input channels;

a delay configured to delay the audio input channels into delayed audio channels that are time-aligned with the upmixed audio channels generated by the stereo upmixer; and an output mixer configured to mix the delayed audio channels and the upmixed audio channels into audio output channels.

2. The audio processing system of claim 1, wherein the audio input channels include audio in a 5.1-surround format having left-front, left-surround, center, right-front and right-surround channels, and the audio output channels include audio in a 7.1-surround format having left-front, left-side, left-back, center, right-front, right-side and right-back channels.

3. The audio processing system of claim 1, wherein the delay delays the audio input channels by a delay amount in accordance with a predetermined processing delay of the stereo upmixer.

4. The audio processing system of claim 1, wherein the input mixer is further configured to:

apply a first amount of gain to left-front and right-front channels of the audio input channels in accordance with mixer settings of the audio processing system;

apply a second amount of gain to left-surround and right-surround channels of the audio input channels in accordance with the mixer settings of the audio processing system;

sum the left-front and left-surround channels, as gain-applied, to generate a left of the stereo output channels; and sum the right-front and right-surround channels as gain-applied, to generate a right of the stereo output channels.

5. The audio processing system of claim 4, wherein the input mixer is further configured to apply one or more of an equalization and a phase change to center, left-surround and right-surround channels of the audio input channels to counteract operations applied to center, left-surround and right-surround channels as mixed.

6. The audio processing system of claim 1, wherein the output mixer is further configured to:

apply a first amount of gain to left-side and right-side channels of the upmixed audio channels in accordance with mixer settings of the audio processing system;

apply a second amount of gain to left-surround and right-surround channels of the delayed audio channels in accordance with the mixer settings of the audio processing system;

sum the left-side and left-surround channels, as gain-applied, to generate a left-side of the audio output channels; and sum the right-side and right-surround channels as gain-applied, to generate a right-side of the audio output channels.

7. The audio processing system of claim 1, wherein the output mixer is further configured to:

apply a first amount of gain to left-back and right-back channels of the upmixed audio channels in accordance with mixer settings of the audio processing system;

apply a second amount of gain to left-surround and right-surround channels of the delayed audio channels in accordance with the mixer settings of the audio processing system;

sum the left- back and left-surround channels, as gain-applied, to generate a left-back of the audio output channels; and sum the right- back and right-surround channels as gain-applied, to generate a right-back of the audio output channels.

8. A method of processing an audio signal comprising:

receiving audio input channels with an audio processor, the audio input channels including audio in a first format;

downmixing at least a subset of the audio input channels into stereo output channels;

developing the stereo output channels into upmixed audio channels using a stereo audio upmixer, the upmixed audio channels including at least one additional surround channel not present in the audio input channels;

delaying the audio input channels into delayed audio channels that are time-aligned with the upmixed audio channels; and generating audio output channels in a second format by mixing the delayed audio channels and the upmixed audio channels for driving a plurality of speakers to reproduce the audio output channels in the second format.

9. The method of claim 8, wherein the first format is a 5.1-surround format having left-front, left-surround, center, right-front and right-surround channels, the input channel format of the audio upmixer is a stereo format, and second format is a 7.1-surround format having left-front, left-side, left-back, center, right-front, right-side and right-back channels.

10. The method of claim 8, wherein the first format and the second format are the same audio format.

11. The method of claim 8, further comprising delaying the audio input channels by a delay amount in accordance with a processing delay of the audio upmixer developing the output channels into the upmixed audio channels.

12. The method of claim 8, further comprising:

applying a first amount of gain to left-front and right-front channels of the audio input channels in accordance with mixer settings of an audio processing system;

applying a second amount of gain to left-surround and right-surround channels of the audio input channels in accordance with the mixer settings of the audio processing system;

summing the left-front and left-surround channels, as gain-applied, to generate a left of the output channels; and summing the right-front and right-surround channels as gain-applied, to generate a right of the output channels.

13. The method of claim 12, further comprising applying one or more of an equalization and a phase change to the left-surround and right-surround channels of the audio input channels to counteract operations applied to the left-surround and right-surround channels as mixed.

14. The method of claim 8, further comprising:

applying a first amount of gain to left-side and right-side channels of the upmixed audio channels in accordance with mixer settings of the audio processing system;

applying a second amount of gain to left-surround and right-surround channels of the delayed audio channels in accordance with the mixer settings of an audio processing system;

summing the left-side and left-surround channels, as gain-applied, to generate a left-side of the audio output channels; and summing the right-side and right-surround channels as gain-applied, to generate a right-side of the audio output channels.

15. The method of claim 8, further comprising:

applying a first amount of gain to left-back and right-back channels of the upmixed audio channels in accordance with mixer settings of the audio processing system;

applying a second amount of gain to left-surround and right-surround channels of the delayed audio channels in accordance with the mixer settings of an audio processing system;

summing the left-back and left-surround channels, as gain-applied, to generate a left-back of the audio output channels; and summing the right-back and right-surround channels as gain-applied, to generate a right-back of the audio output channels.

16. A non-transitory computer-readable medium comprising instructions that, when executed by an audio processor, are configured to cause the audio processor to:

receive audio input channels with the audio processor, the audio input channels including stereo and one or more surround channels;

downmix at least a subset of the audio input channels into stereo output channels;

develop the stereo output channels into upmixed audio channels including at least one additional surround channel not present in the audio input channels;

delay the audio input channels into delayed audio channels that are time-aligned with the upmixed audio channels; and mix the delayed audio channels and the upmixed audio channels into audio output channels.

17. The medium of claim 16, wherein the audio input channels include audio in a 5.1-surround format having left-front, left-surround, center, right-front and right-surround channels, and the audio output channels include audio in a 7.1-surround format having left-front, left-side, left-back, center, right-front, right-side and right-back channels.

18. The medium of claim 16, further comprising instructions configured to cause the audio processor to:

apply a first amount of gain to left-front and right-front channels of the audio input channels in accordance with mixer settings of an audio processing system;

apply a second amount of gain to left-surround and right-surround channels of the audio input channels in accordance with the mixer settings of the audio processing system;

sum the left-front and left-surround channels, as gain-applied, to generate a left of the stereo output channels; and sum the right-front and right-surround channels as gain-applied, to generate a right of the stereo output channels.

19. The medium of claim 18, further comprising instructions configured to cause the audio processor to apply one or more of an equalization and a phase change to the left-surround and right-surround channels of the audio input channels to counteract operations applied to the left-surround and right-surround channels as mixed.

20. The medium of claim 16, further comprising instructions configured to cause the audio processor to:

apply a first amount of gain to left-side and right-side channels of the upmixed audio channels in accordance with mixer settings of an audio processing system;

apply a second amount of gain to left-surround and right-surround channels of the delayed audio channels in accordance with the mixer settings of the audio processing system;

apply a third amount of gain to left-back and right-back channels of the upmixed audio channels in accordance with the mixer settings of the audio processing system;

apply a fourth amount of gain to left-surround and right-surround channels of the delayed audio channels in accordance with the mixer settings of the audio processing system;

sum the left-side and left-surround channels, as gain-applied, to generate a left-side of the audio output channels;

sum the right-side and right-surround channels as gain-applied, to generate a right-side of the audio output channels;

sum the left- back and left-surround channels, as gain-applied, to generate a left-back of the audio output channels; and sum the right-back and right-surround channels as gain-applied, to generate a right-back of the audio output channels.

* * * * *